US005215864A

United States Patent [19]

Laakmann

[11] Patent Number: 5,215,864

[45] Date of Patent: Jun. 1, 1993

[54] METHOD AND APPARATUS FOR MULTI-COLOR LASER ENGRAVING

[75] Inventor: Peter Laakmann, Seattle, Wash.

[73] Assignee: Laser Color Marking, Incorporated, Bothell, Wash.

[21] Appl. No.: 590,152

[22] Filed: Sep. 28, 1990

[51] Int. Cl.[5] ..... G03C 5/00

[52] U.S. Cl. ..... 430/293; 430/297; 430/945; 148/244; 204/157.41; 427/53.1; 427/154; 427/556

[58] Field of Search ..... 430/9, 17, 293, 297, 430/945; 148/244; 204/157.41, 157.61; 427/53.1, 154

[56] References Cited

U.S. PATENT DOCUMENTS 3,833,374 9/1974 Patrick ..... 430/293

3,841,891 10/1974 Pallant ..... 430/293

*Primary Examiner*—Marion E. McCamish
*Assistant Examiner*—Kathleen Duda
*Attorney, Agent, or Firm*—Seed and Berry

[57] ABSTRACT

A method and apparatus for engraving a metal plate in two or more colors. Selected areas of an oxidized aluminum plate are colored by a first dye to which the plate has an affinity. The selected areas may then be sealed by hydration. Portions of the selected areas of the colored oxidized aluminum plate can then be further engraved by the application of a focussed laser beam, which removes any of the first dye and the sealant, thereby restoring the affinity of the selected portions of the plate. The areas of the plate having an affinity for dyes can be colored by secondary and additional colors and shades thereof.

19 Claims, 2 Drawing Sheets

METHOD AND APPARATUS FOR MULTI-COLOR LASER ENGRAVING

DESCRIPTION

1. Technical Field

This invention relates to a method and apparatus for creating an engraved image and, more particularly, to a method and apparatus for creating a multi-color engraved image using a laser.

2. Background Art

Engraving of anodized aluminum panels by a spot of laser light is well known and is in common use for creating labels, instruments panels, artwork and other uses. Presently known laser engraving usually entails spot sizes between 0.002 and 0.010 inch at power levels between 5 and 50 Watts and writing speeds between about 0.5 and 5 feet per second. The spot is typically moved with a computer graphics system, scanning mirrors or x-y tables. Typically laser engraving has been a white-on-base color process, with the base color most often being black. Base colors other than the commonly used black are possible, particularly red, blue, gold and grey.

It would be desirable to have a system to create laser engraved panels that can provide the much wider range of colors available in paint and silk screening processes. Such a system would then combine the precision, flexibility and speed of laser engraving with the range of base and character colors available in paint-based systems, without the inflexibility and lead times involved in the tooling for paint-based systems.

DISCLOSURE OF THE INVENTION

In the disclosed embodiments, this invention is concerned with creating a multi-color engraved image in anodized aluminum panels using a carbon-dioxide laser, although the laser engraving methods and apparatus disclosed can be modified to be applied to other substrate materials, particularly other metals.

It is well known that an anodized aluminum surface consists of a porous surface having microscopic channels oriented at right angles to the surface. These porous channels can hold a dye and the pores can be sealed by application of heat and water to hydrate the $Al_2O_3$. The hydration expands the surface material by the molecular inclusion of water so that the pores are essentially eliminated and any dye contained within the now glassy appearing surface is trapped. I have found that the laser beam not only vaporizes the dye but also removes the hydration, reestablishing the previous affinity for new dyes. The laser engraved areas can therefore be redyed and sealed in multitudes of secondary colors. This process can be repeated to not only create color-on-background but also color-on-color effects.

The preparation of anodized aluminum panels consists of a first step of anodizing using electric current in an acid bath. This creates a porous surface of a few tenths of a thousandth of an inch consisting of alumina, $Al_2O_3$. The surface thus created consists of micro-channels running at right angles to the surface. When the surface is subsequently exposed to boiling water these micro-channels can be sealed by creating a hydrated form of $Al_2O_3$ and a clear or natural color. This makes the surface less sensitive to contamination and environmentally stable. During the above sealing operation with boiling water, dyes can be introduced to create the familiar black, blue, red, gold or grey shades of anodized aluminum.

It has been found that exposing this surface to focussed intense laser radiation reverses the hydration and vaporizes any dye applied earlier, creating the original white state of $Al_2O_3$ with its porous micro-channels and high affinity for dyes.

The surface areas thus converted by the laser can then be redyed selectively in any number of secondary colors by applying dye to individual areas within the image. The applied dye will essentially only be absorbed by areas touched by the laser beam, not the surrounding areas. The precision of the color image is therefore established by the laser marking process, not the dye application. More than one secondary color can be used simultaneously in different parts of the image, by selective manual or automatic application, to produce a multi-colored, color-on-background image, as long as the colored areas are not overlapping. The subsequent sealing can be accomplished when using water soluble dyes by exposure to heat. Overcoats can be used for further protection.

At this point the sealed selected secondary colors can also be reengraved and dyed as before to produce images in a set of tertiary colors as desired, having color on color image effect, rather than the simpler color on background effect as described above. This process can of course be extended to even higher order coloring processes.

It is an object of the present invention to provide a method for establishing a multi-color engraved image on a surface of a substrate material.

It is another object of the present invention to provide an apparatus for establishing a multi-color engraved image on a surface of a substrate material.

It is a further objective of the present invention to provide a process that can work on any type of surface that can be locally and selectively converted in its dye affinity by a laser. For example, one can visualize an absorbent paper type coating or film applied to a substrate. This coating may have a thin plastic protective coating applied to its surface which the laser can remove to expose areas of dye affinity, or the laser could remove the absorbent layer completely to create islands of dye affinity.

According to one aspect, the invention is an apparatus for establishing a multi-color engraved image by means of a laser on an oxidized metal surface. The apparatus comprises means for establishing a surface having high affinity to a dye, for optionally introducing the dye and sealing the surface so that it no longer has affinity for dyes, means for selectively engraving areas of the metal surface by means of a focussed laser beam to reestablish affinity for new dyes, means for introducing at least one secondary dye to the selectively engraved areas, and means for sealing the secondary dyes.

In a further aspect, the invention is a method for establishing a multi-color engraved image having a first color and a second color on an oxidized metal surface having an affinity to a dye. The method comprises the steps of a) applying a first dye having the first color to the surface, b) sealing the surface where the first dye was applied, thereby substantially reducing the affinity of the surface to a dye, c) selectively engraving areas of the metal surface to which the first dye is applied by a laser beam that removes the first dye and substantially reestablishes the affinity, and d) applying secondary dyes to the selectively engraved areas of the metal surface.

BEST MODES FOR CARRYING OUT THE INVENTION

It has been observed experimentally that conventional laser engraving of anodized aluminum panels will restore the original affinity of the surface of the metal panel to new dyes introduced selectively to the engraved areas. Surrounding areas not touched by the laser will not absorb the new dye. High precision in the secondary dye process is therefore not required, since laser engraving is a highly precise process. After application of the secondary dyes the panel can be oversprayed using a transparent lacquer to protect and seal the dyes. Because of the extremely small pore sizes of the anodization, a low viscosity dye is necessary. For manual dyeing, a type of water soluble dye found in felt tipped pens has been found useful. Note that the precision of the color image is primarily established by the precision of the laser image—not the precision or skill of the dye application. In this way the invention differs fundamentally from a "painting" process.

Figure 1:
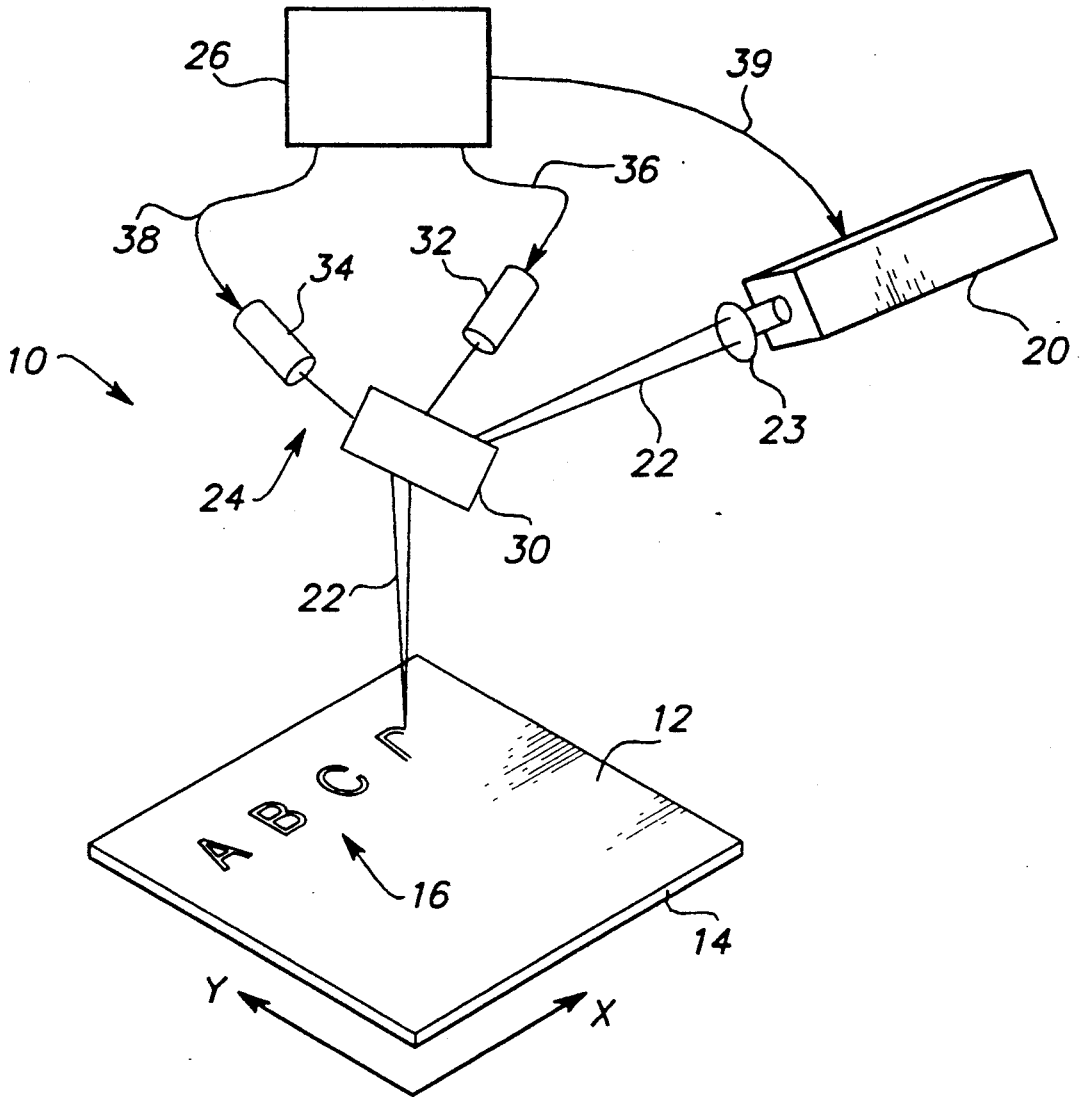
FIG. 1 is a schematic diagram of a first embodiment of the laser engraving apparatus of the invention.

FIG. 1 is a schematic diagram of a first embodiment of the laser engraving apparatus 10 of the invention. The laser engraving apparatus 10 is used to engrave a surface 12 of a substrate 14 with any desired characters or other image 16. The laser engraving apparatus 10 includes a laser source 20 producing a beam 22 of laser energy, focusing lens 23, optic means 24 for directing the beam 22 from the laser source 20 onto the substrate surface 12, and control means 26 for controlling the laser source 20 and the optic means 24.

The substrate 14 can be any suitable material, and the surface 12 can be made from any material which has a first affinity for colored dyes before being subjected to the beam 22 of laser energy and a different second affinity for colored dyes after being subjected to the beam 22 of laser energy. It is particularly suitable for the surface 12 to be made from a metal, such as aluminum, having an oxide, such as alumina ($Al_2O_3$).

Further improvements in the technique can be obtained by overspraying the anodized and hydrated surface with, for example, an acrylic coating. The laser will vaporize the coating and any dye below it to expose the unhydrated $Al_2O_3$. By this method it is possible to create background colors other than those available with anodizing. By this method a white background for subsequent engraving can be achieved. A clear overcoat prior to engraving can be used to further reduce affinity and adhesion of secondary dyes to the surface where they are not wanted.

The optic means 24 may comprise an optical element 30, such as a mirror, for deflecting the beam 22 that passes from the laser source 20, through the focusing lens 23, toward the surface 12. The optical element 30 can be rotated independently about x- and y-axes by stepper motors 32 and 34, respectively, as directed by signals received through the respective cables 36 and 38. The stepper motors are under the control of the control means 26, which may be a computer programmed in accordance with principles well-known to those skilled in the programming art. The control means 26 also controls the laser source 20 through the signal cable 39 by appropriately modulating the intensity of the laser light in the beam 22 between intensities which will not affect the affinity of the surface 12 and intensities which will. If desired, the laser source 20 can be turned off and on by the control means 26. For example, when it is desired to define discrete areas, such as letters on the surface 12, the control means 26 can turn on the laser source 20 when it is forming each area using appropriate manipulation of the mirror 30 by the stepper motors 32 and 34. It can also turn the laser source 20 off when the beam 22 is to be directed from one area to another area of the surface 12 without engraving the space between the two areas.

Figure 2:
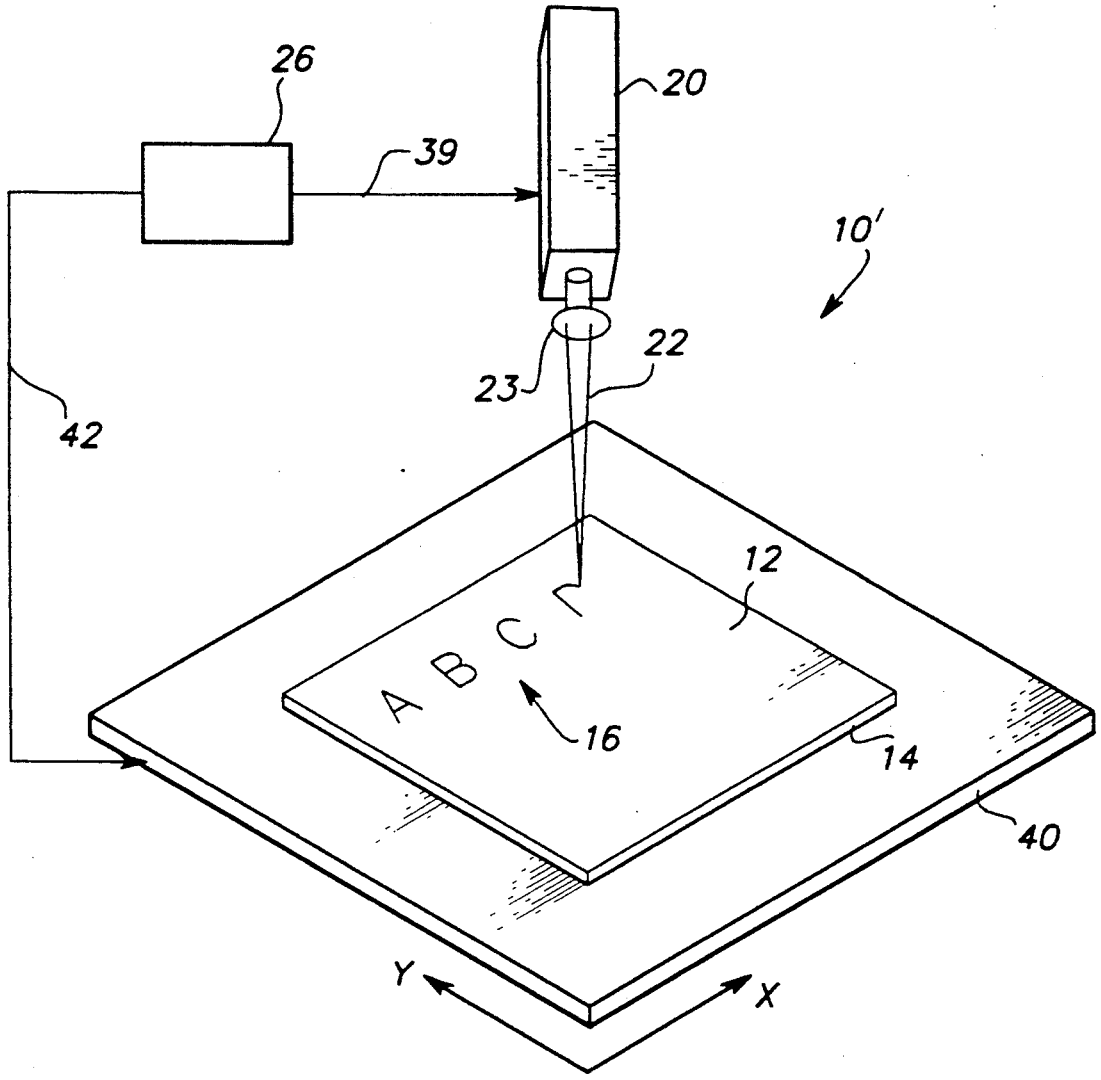
FIG. 2 is a schematic diagram of a second embodiment of the laser engraving apparatus of the invention.

FIG. 2 is a schematic diagram of a second embodiment of the laser engraving apparatus 10' of the invention. Those features of FIG. 2 which are the same as those in FIG. 1 are given the same reference numerals in the two figures. In the second embodiment, the substrate 14 having the surface 12 is placed on an x-y table 40 which is capable of independent translations in the directions of the x- and y-axes under the control of the control means 26 through the cable 42. The laser source 20 and focusing lens 23 are held in fixed position while the x-y table 40 moves the substrate 14 to change the point at which the beam 22 strikes the surface 12. The control means 26 controls the laser source 20 through the cable 39.

While the detailed description above has been expressed in terms of a specific examples, those skilled in the art will appreciate that many other methods could be used to accomplish the purpose of the disclosed inventive apparatus. Accordingly, it can be appreciated that various modifications of the above-described embodiments may be made without departing from the spirit and the scope of the invention. Therefore, the present invention is to be limited only by the following claims.

I claim:

1. A process for making a laser engraved image having at least two colors established in predetermined areas on a metal surface by a process that consists of converting the metal surface to an oxide of the metal having a high affinity to a first dye having a first color, applying the first dye to the portion of the surface, sealing the predetermined areas on the metal surface, simultaneously selectively unsealing the surface in a portion of the predetermined areas and removing the first dye in the portion of the predetermined areas by a focussed laser beam that reestablishes substantially the original affinity of the portion of the surface in the predetermined areas, and applying a second dye having a second color to the portion of the surface in the predetermined areas.

2. The process of claim 1 wherein the step of sealing the predetermined areas on the metal surface includes decreasing the affinity of the predetermined areas on the metal surface to dyes.

3. The process of claim 2, further comprising the step of sealing the laser engraved image having at least two colors by a lacquer overspray.

4. The process of claim 2 wherein the laser engraved image having at least two colors is sealed by the same process as the process for sealing the predetermined areas on the metal surface.

5. The process of claim 4 wherein the metal surface is aluminum and the step of sealing the laser engraved image having at least two colors is achieved by hydrating the aluminum oxide with hot water.

6. The process of claim 2 wherein the metal surface is aluminum and the step of sealing the predetermined areas on the aluminum surface is performed by hydrating the aluminum oxide with hot water.

7. The process of claim 2, further comprising the step of further removing a portion of at least one of the first or second dyes and applying a third dye thereon.

8. The process of claim 1 wherein the metal surface is aluminum and the step of converting the metal surface to an oxide is performed by anodizing.

9. In a multi-step process using focussed energy from a laser to engrave the surface of a substrate, the steps of first preparing a portion of the substrate surface to have either very high or very low affinity for a chosen dye; converting a portion of the said prepared surface by said focussed laser energy to the opposite affinity state; and applying a dye to the substrate surface to impregnate the dye into said substrate surface in order to create an image whose outline is substantially given only by the portions of the substrate surface that are converted by the laser.

10. The multi-step engraving process of claim 9, further comprising the step of reconverting the surface converted by the laser and impregnated by the second dye to have a low affinity for a chosen dye so that a subsequent engraving process can be applied to the substrate surface to create color-on-color images.

11. A method for establishing an engraved image having a first color on an oxidized metal surface having an affinity to a dye, comprising the steps of:

a) sealing the metal surface, thereby substantially reducing the affinity;

b) selectively engraving areas of the metal surface that was sealed, the engraving being done with a focussed laser beam to substantially reestablish the affinity in the selectively engraved areas of the metal surface;

c) applying a first dye having the first color to the areas of the metal surface that were engraved with the focussed laser beam; and d) sealing the areas of the metal surface that were engraved with the focussed laser beam, thereby substantially reducing the affinity.

12. The method of claim 11, further comprising the steps of e) selectively engraving areas of the metal surface that was sealed in step d), the engraving being done with a focussed laser beam to substantially reestablish the affinity in the selectively engraved areas of the metal surface; and f) applying a second dye having a second color to the areas of the metal surface that were engraved with the focussed laser beam in step e).

13. The method of claim 11 wherein the metal is aluminum, the oxidized metal surface is $Al_2O_3$, and the step of sealing the metal surface comprises hydrating the $Al_2O_3$ with hot water.

14. The method of claim 11, further comprising the step of:

e) reestablishing substantially the original affinity of the portion of the surface in the predetermined areas that are engraved by the laser, and to which the first dye is applied so that subsequent engraving process can be applied to the metal surface to create color-on-color images.

15. A method for establishing an engraved image having a color on a metal surface, comprising the steps of:

a) converting the metal surface to a metal oxide;

b) sealing the metal surface, thereby substantially reducing the affinity;

c) selectively engraving areas of the metal surface with a focussed laser beam to substantially establish an affinity of the selectively engraved areas of the metal surface to the color; and d) applying a dye having the color to the metal surface.

16. The method of claim 15 wherein the metal is aluminum, the metal oxide is $Al_2O_3$, and the step of sealing the metal surface comprises hydrating the $Al_2O_3$ with hot water.

17. The method of claim 15 wherein the metal is aluminum and the step of converting the metal surface to a metal oxide is achieved by anodizing.

18. The method of claim 17 wherein the metal oxide is $Al_2O_3$ and the step of sealing the metal surface comprises hydrating the $Al_2O_3$ with hot water.

19. The method of claim 15, further comprising the step of applying a dye having a color different from the first color to the metal surface before performing step (b) and wherein step (c) also includes selectively engraving areas of the metal surface with a focussed laser beam to remove the color different form the first color from portions of the metal surface.

* * * * *

UNITED STATES PATENT AND TRADEMARK OFFICE

CERTIFICATE OF CORRECTION

PATENT NO. : 5,215,864

DATED : June 1, 1993

INVENTOR(S) : Peter Laakmann

It is certified that error appears in the above-identified patent and that said Letters Patent is hereby corrected as shown below:

In column 6, claim 15, line 19, before "color", please insert --first--.

In column 6, claim 15, line 27, before "color", please insert --first--.

In column 6, claim 15, line 28, before "color", please insert --first--.

In column 6, claim 19, line 46, please delete "form" and substitute therefor --from--.

Signed and Sealed this

Fifth Day of April, 1994

Bruce Lehman

*Attest:*

BRUCE LEHMAN

*Attesting Officer*

*Commissioner of Patents and Trademarks*